United States Patent [19]

Pryor

[11] Patent Number: 4,585,409

[45] Date of Patent: Apr. 29, 1986

[54] SPRING LOADED HEATING TORCH TIP

[75] Inventor: David A. Pryor, Denton, Tex.

[73] Assignee: Victor Equipment Company, Denton, Tex.

[21] Appl. No.: 644,226

[22] Filed: Aug. 27, 1984

[51] Int. Cl.[4] ..... F23D 14/82

[52] U.S. Cl. ..... 431/346; 239/391; 239/424; 266/48; 266/904; 431/354

[58] Field of Search ..... 431/344, 346, 354; 126/401, 406, 413; 239/390, 391, 397, 424; 222/3; 266/48, 904

[56] References Cited

U.S. PATENT DOCUMENTS

| | | | |
|---|---|---|---|
| 1,274,052 | 7/1918 | Jenkins | 239/397 X |
| 1,409,220 | 3/1922 | Leighty et al. | 239/390 X |
| 3,928,084 | 12/1975 | Etter | 239/424 X |
| 4,022,441 | 5/1977 | Turney | 431/346 X |
| 4,200,235 | 4/1980 | Monschke | 239/424.5 |
| 4,248,384 | 2/1981 | Zwicker | 239/424.5 X |
| 4,314,672 | 2/1982 | Madewell et al. | 239/424 |
| 4,409,002 | 10/1983 | Zwicker | 431/346 X |

FOREIGN PATENT DOCUMENTS

| | | | |
|---|---|---|---|
| 1155016 | 4/1958 | France | 239/391 |

*Primary Examiner*—Margaret A. Focarino
*Attorney, Agent, or Firm*—Wofford, Fails & Zobal

[57] ABSTRACT

An improved heating torch having the usual fuel and oxygen passageways and valves for controlling the flow of the respective components, mixer for mixing fuel and oxygen, and tip for flowing the admixture exteriorly thereof for burning to heat a work piece or the like, the improvement being characterized by a multiple piece tip that is spring loaded such that one or more internals can be spring loaded to be retained within a shell that is affixed to an end piece of the tip. The end piece fastens to the end of an elbow connected with the mixer, and has the shell disposed about the end piece; and one or more tip internals are disposed inside and biased toward their normal assembled position by a spring or the like. Different sized heating tips are readily formed by simply adding internals and larger sized end pieces and shells to form one or more rings of grooves defined by splines that can be easily manufactured and assembled. In addition, the heating torch tip is amenable to underwriter approval, since it alleviates problems with flashback and burning due to striking of a heating tip against a work piece or other objects during handling.

10 Claims, 19 Drawing Figures

Fig. 1
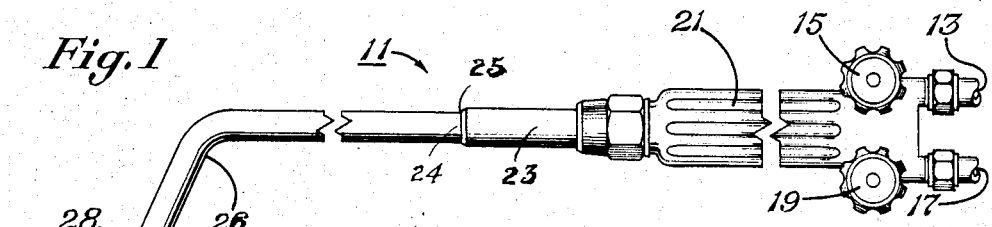
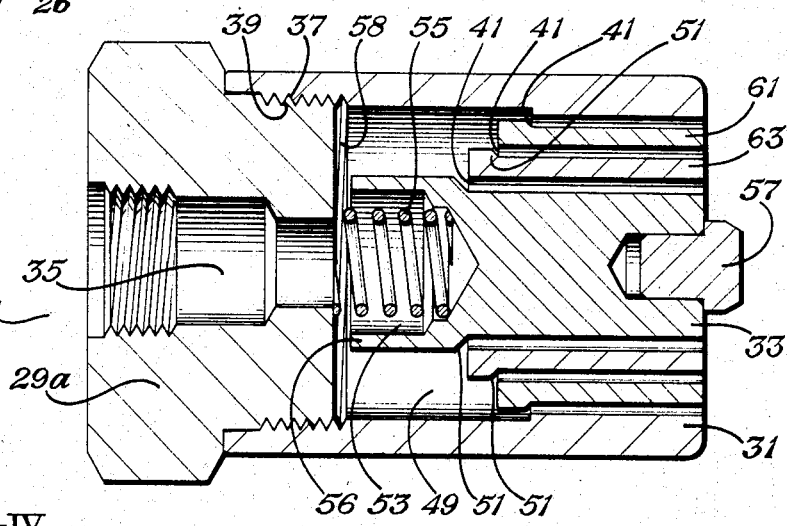
Fig. 2
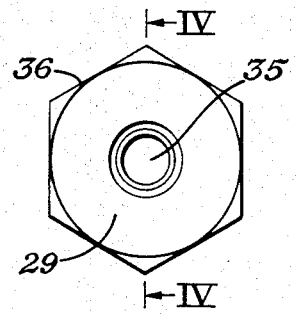
Fig. 3
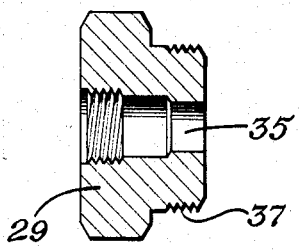
Fig. 4
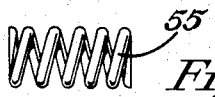
Fig. 5
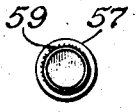
Fig. 6
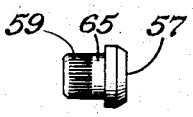
Fig. 7
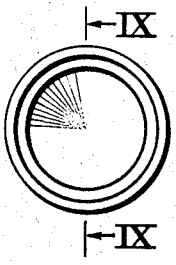
Fig. 8
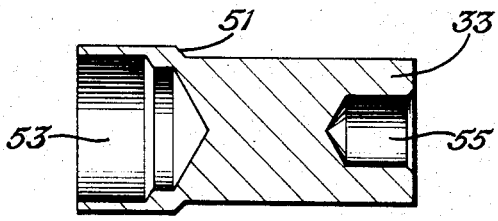
Fig. 9

SPRING LOADED HEATING TORCH TIP

FIELD OF THE INVENTION

This invention relates to heating torch tips. More particularly, this invention relates to improvements in heating torch tips which alleviates problems with flashback and burning, and facilitates manufacture and assembly.

BACKGROUND OF THE INVENTION

A wide variety of different approaches have been known in the manufacturing of heating torch tips. These have included attachments for cutting torch tips, as well as the heating torch tips, per se. For example, about the best prior art tips were those that employed milled external cuts or splines on the exterior of a mold that could be moved to an exact position longitudinally of a master outer tip and then pinned into place. This was very costly in manufacture as well as requiring exact emplacement and then drilling through circular shells. Once the pins were worn, the respective tip had pieces that were loose and rattled and in severe cases could blow out. Of course other torch tips having formed apertures therein are known but did not perform as well as the above described tip construction. Moreover, the old style forming of the exterior milled cuts or splines caused burrs. The burrs in turn were difficult to clean and potentially could create hot spots so the possibilities of pre-ignition of the gas within the tip became possible. Moreover, the burrs interiorly of the tip, if not throughly cleaned, caused uneven flame and a tip that did not perform satisfactorily.

In addition, a wide variety of machine-type heating torches have been known. These type heating torches had structure that might seem superficially similar but, in fact, did not function and could not be employed as in this invention.

The most pertinent art of which applicant is aware in the published literature are formed by the following United States patents issued to co-workers and assigned to the assignee of this invention. These patents are: U.S. Pat. Nos. 4,022,441, Turney, "UNIVERSAL TORCH"; 4,200,235, Monschke, "MULTIPLE PIECE TORCH TIP"; 4,248,384, Zwicker, "CUTTING TORCH WITH SINGLE DRILLED PASSAGEWAYS"; 4,314,672, Madewell et al, "BEVELING TIP". Even the technology and innovation in these improved tips were directed more at cutting torches and did not provide the answers which the heating torch tip of this invention provides.

SUMMARY OF THE INVENTION

Accordingly, it is an object of this invention to provide a heating torch tip that alleviates the problems of the prior art; is readily manufactured and assembled; does not require expensive cleaning of burrs and exact placement, drilling and pinning; that provides even heating; and that alleviates problems with flashback and burning.

It is a specific object of this invention to provide a multiple piece torch tip improvement in a heating torch in which multiple concentric radials of apertures provide a heating flame that is uniform, that can be easily manufactured and economically assembled and that alleviates the problem with flashback and burning; as well as accomplishes the foregoing object.

These and other objects will become apparent from the descriptive matter hereinafter, particularly when taken in conjunction with the appended drawings.

In accordance with this invention there is provided an improvement in a heating torch in which a fuel and oxygen admixture is fed to a tip and burned at high temperature exteriorly of the torch tip for heating a work piece or the like and including:

a. a fuel passageway and valve for supplying a controlled flow of fuel;

b. an oxygen passageway and valve for supplying a controlled flow of oxygen;

c. a mixer for mixing the fuel and oxygen, the mixer being connected in fluid communication with both said fuel and oxygen passageways and valves and having a discharge end; and d. a tip for flowing the admixture of fuel and oxygen exteriorly of the tip for burning adjacent the work piece for heating thereof;

the improvement comprising having the tip in the form of a multiple piece unit comprising:

e. an end piece having at one end a centrally disposed aperture and passageway, the aperture and passageway having a section adapted to matingly and sealingly engage the discharge end of the mixer; the end piece having at its other end a shell attachment means for attaching a shell;

f. the shell having an end piece attaching means for sealingly connecting with the shell attaching means and having an internal stop means for holding at least one tip internal interiorly thereof;

g. at least one tip internal disposed interiorly of the shell; said tip internal having an external stop means for keeping the tip internal interiorly of the shell responsive to the internal stop means of the shell and having a receiving means for receiving a biasing means for biasing the tip internal toward the internal stop means of the shell;

h. a stub disposed in the external end of the at least one tip internal; and i. the biasing means for biasing said tip internal toward the internal stop means of the shell, the biasing means being disposed so as to accomplish the biasing such that the at least one tip internal can be easily and readily manufactured and assembled interiorly of the shell and the biasing means emplaced and such that the biasing means will allow hitting the stub against the work piece or the like without flashback and burning. It is noteworthy that if the user is willing to forego the safety factor of having the stub disposed in the innermost tip internal, it can be dispensed with, although this dispensing makes the tip vulnerable to encountering a surface, molten metal or otherwise effecting a flashback common to the prior art tips.

BRIEF DESCRIPTION OF THE DRAWINGS

FIG. 1 is a side elevational view, partly schematic and partly broken away, showing a typical heating torch in accordance with one embodiment of this invention.

FIG. 2 is a side cross-sectional view of the improved tip of FIG. 1 in accordance with one embodiment of this invention.

FIG. 3 is a top view of the end piece of the tip of FIG. 2.

FIG. 4 is a cross-sectional view taken along the lines IV—IV of FIG. 3.

FIG. 5 is a side elevational view of the spring forming the biasing means of FIG. 2.

FIG. 6 is an end view of the stub of FIG. 2.

FIG. 7 is a side elevational view of the stub of FIG. 6.

FIG. 8 is an end view of the innermost tip internal of FIG. 2.

FIG. 9 is a cross-sectional view taken along the lines IX—IX of FIG. 8.

FIG. 19 is an isometric view of the torch tip of FIG. 2 emplaced on a mixer and showing the concentric rings of grooves formed by the splines on the interior of the respective internals and skirt so as to form a uniform heating tip and showing the protrusion of the stub to prevent backfiring of the tip if hit against metal or the like.

DESCRIPTION OF PREFERRED EMBODIMENT(S)

Figure 10:
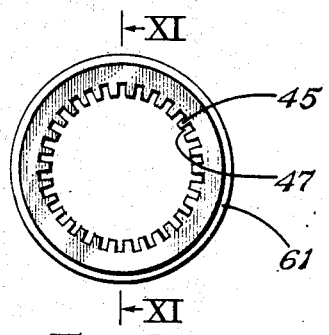
FIG. 10 is an end view of an inner tip internal of FIG. 2.
Figure 11:
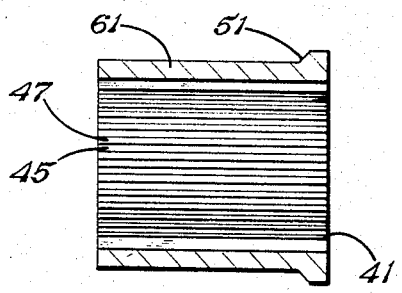
FIG. 11 is a cross-sectional view taken along the lines XI—XI of FIG. 10.
Figure 12:
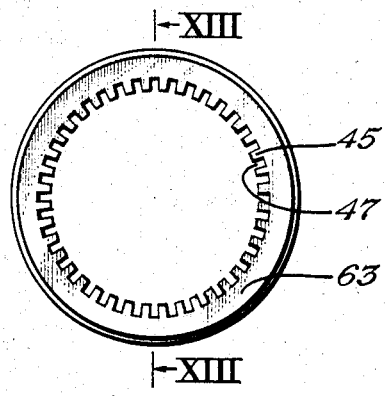
FIG. 12 is an end view of the outer tip internal of FIG. 2.
Figure 13:
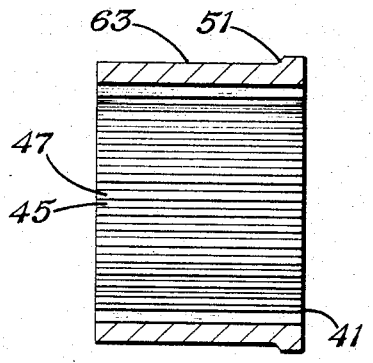
FIG. 13 is a cross-sectional view taken along the line XIII—XIII of FIG. 12.

It should be borne in mind that the improvement of this invention may be useful in a wide variety of instances. For example, it can be employed in combination with mixers alone or with heating tips with mixer passageways disposed centrally thereof. It can be employed with attachments for cutting torches, or for heating torches per se.

Referring to the figures and in particular FIG. 1, there is illustrated a heating torch 11 in accordance with one embodiment of this invention. In the heating torch 11, fuel and oxygen are supplied through respective fuel passageway 13 and fuel valve 15, and oxygen passageway 17 and oxygen valve 19. Respective fuel and oxygen are then conducted through the torch handle 21, ordinarily by separate conduits or passageways, into a mixer 23. The mixer 23 is in fluid communication with both the fuel and oxygen passageways and valves and has a discharge end 25, such as a female threaded end (threads not shown). An elbow 26 has a first male threaded end 24 that is connected to the discharge end 25, as by being screwed into the female threaded end 25. The elbow has male threaded end 28 at its other end that is screwed into the tip 27. The tip 27 flows the fuel and oxygen exteriorly thereof and effects an even distribution of the admixture for burning adjacent a work piece for the heating of the work piece.

The listed respective elements of a heating torch may be formed of the same material; such as brass, stainless steel or the like; as are conventionally employed in such heating torches and no exotic new materials are required in this invention.

The primary improvement of this invention lies in the construction of the tip 27. The tip 27 is a multiple piece unit such as illustrated in FIG. 2.

Figure 16:
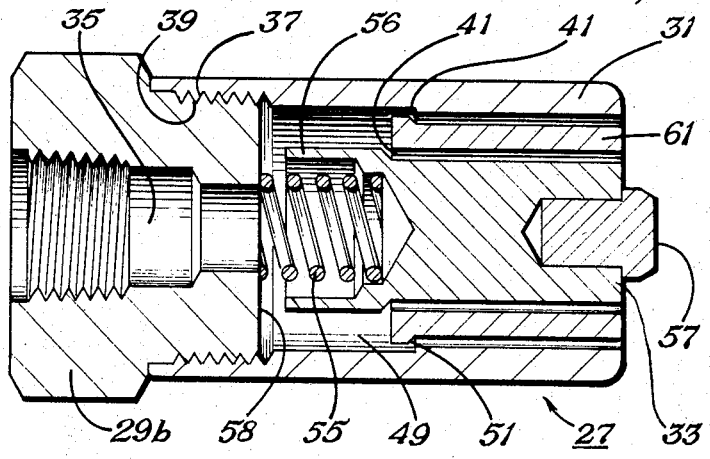
FIG. 16 is a cross-sectional view of the tip of another embodiment in which only one intermediate tip internal is employed.
Figure 17:
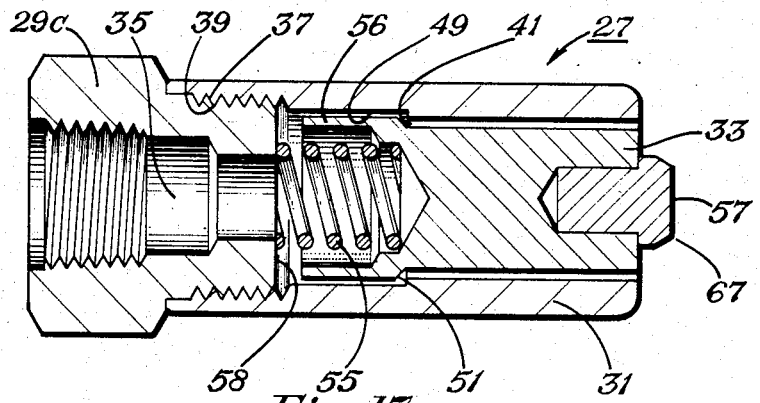
FIG. 17 is a cross-sectional view of another embodiment of the invention in which only the innermost tip internal is employed.

FIG. 2 illustrates the most elaborate tip conventionally manufactured and sold by the assignee; and FIGS. 16 and 17 illustrate somewhat smaller tips for less severe heating requirements.

The tip 27 includes an end piece 29, an attached shell 31 and at least one tip internal 33 disposed interiorly of the shell.

The end pieces 29, FIGS. 3 and 4, are sized as needed for the heating job. For example, in FIG. 2, the end piece 29*a* is a relatively large end piece for putting a plurality of intermediate tip internals within the shell for producing large amounts of heat. On the other hand, FIG. 16 illustrates a smaller tip and end piece 29*b* for a lesser amount of heat. Furthermore, FIG. 17 illustrates a very simple embodiment in which only a small amount of heat is required and a still smaller tip and end piece 29*c* is employed with a relatively small shell 31 affixed thereto. The end piece 29 has at one end a centrally disposed aperture and passageway 35 for matingly and sealingly engaging the discharge end of the elbow. As illustrated, the elbow has a male threaded end and the aperture and passageway of the end piece has a female threaded end that matingly and sealingly receives the threaded end 28 of the mixer 23.

As can be seen in FIGS. 3 and 4, the end piece 29 will have straight edges 36, as formed by square, hexagonal, octagonal or other such shapes so as to be readily held by a wrench or the like; either for screwing onto the discharge end 28 of the elbow 26 or for having the shell 31 screwed onto the shell attachment means in the form of male threads 37.

The end piece 29 has at its other end 37 a shell attaching means such as male threads for attaching a shell 31. The end piece may be machined from brass or the like in accordance with conventional torch technology. On the other hand, it may comprise stainless steel.

Figure 14:
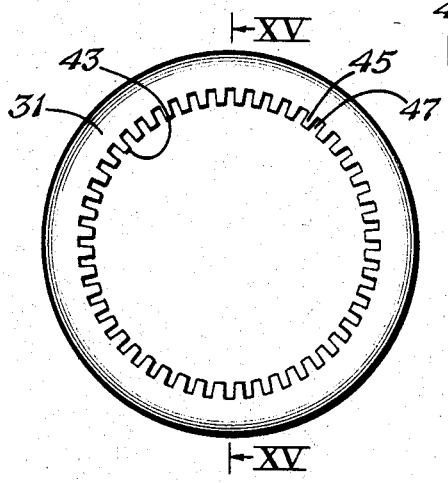
FIG. 14 is an end view of the shell of FIG. 2.
Figure 15:
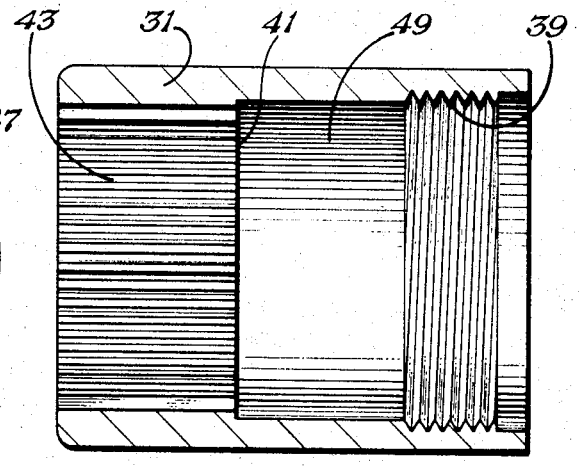
FIG. 15 is a cross-sectional view taken along the lines XV—XV of FIG. 14.

The shell 31 has at one end the end piece attaching means comprising female threaded section 39, FIG. 15, for matingly engaging the male threaded section 37 of the end piece 29. The shell has an internally disposed stop means for holding the at least one internal interiorly thereof. As illustrated, the internal stop means 41 comprises shoulders, or square ends 41 of splines 43, FIGS. 14 and 15. Specifically, the shell has splines 45 traversing longitudinally and defining grooves 47 for conveying the admixture of fuel and oxygen to the end of the tip so it can be burned to effect the desired heating.

The shell 31 also has a cylindrically shaped section 49 allowing for slideable longitudinal movement of the one or more tip internals therewithin.

The at least one tip internal 33 is disposed interiorly of the shell 31. The tip internal has an external stop means for keeping it interiorly of the shell responsive to the internal stop means of the shell and has a receiving means for receiving a biasing means for biasing the tip internal toward the internal stop means of the shell. Specifically referring to FIGS. 2, 9, 16 and 17, the tip internal 33 has its external shell means in the form of a radially protruding shoulder 51 that is responsive to the stop means 41 of the shell, either directly or by way of intermediate tip internals. The receiving means illustrated is in the form of a well 53 for receiving a coil spring 55, FIG. 5 serving as the biasing means in the illustrated embodiment. Of course other forms of the biasing means and receiving means could be employed but the illustrated form has been found particularly satisfactory in facilitating assembly of the torch tip of this invention. As illustrated, the well 53 is illustrated at the interior end for receiving the coil spring 55 immediate it and the end piece 29. At the other end, the tip internal 33 includes a well 55 for receiving a stub 57, FIGS. 2, 6, 7, 9, 16 and 17.

As can be seen in FIGS. 2, 16 and 17, the well has cylindrical walls 56 that are pushed into engagement with the flat surface 58 of the end piece by a severe blow to the end; for example, hitting the stub 57 of the tip against a surface. This movement of the cylindrical walls 56 into the flat surface 58 blocks the flame from backfiring into the mixer, thereby eliminating flashback and burning.

The stub may be inserted in a simple interference fit. As illustrated in FIGS. 6 and 7, the stub has small splines 59 to facilitate keeping it in place once it is driven into the well 55. The stub acts to encounter metal of the workpiece or the like when it is hit inadvertently during the heating process; and pushes inwardly on the internals to affect slideable movement thereof and prevent the grooves 47 from being plugged by molten metal or otherwise interrupting flow to cause a backfire and attendant burning. The stub is preferably formed of metal such as brass, stainless steel or the like to endure the high temperatures in the presence of oxygen without severe corrosion.

Use of a plurality of tip internals allows creating different size torches for different heating requirements easily without the necessity of storing a large number of different sized torch tips. Expressed otherwise, one or more intermediate externals may be employed between the innermost tip internal 33 and the shell 31, as illustrated in FIGS. 2 and 16. For example, in FIG. 16, there is employed one tip internal 61 intermediate the innermost tip internal 33 and the shell 31. The same tip internal 61 is shown in FIG. 2 as an outer tip internal since it is next to the shell 31. As described by the generic provisions heretofore, the outer tip internal 61 contains the shoulder 51 for engaging the squared off shoulder 41 of the shell splines and thus forms co-engaging stop means, inside of the shell and the outside of the outer tip internal. Conversely, the outer tip internal has squared off shoulders 41 on its interior spline so as to form an internal stop means that are in turn engaged by the outer stop means formed by the exterior shoulder 51 on the inner tip internal 63 of FIG. 2. The inner tip internal 63 also has shoulders 41 for engaging the outer protruding shoulders 51 of the next concentrically interior tip internal such as the innermost tip internal 33. The shoulders 51 are cut at a 45 degree angle so as to facilitate slipping interiorly of the sharp shoulders 41 on the splines. This facilitates assembly and allows the respective intermediate tip internals, as well as the innermost tip internal 33, to be dropped readily into place to assemble the tip.

As implied hereinbefore, and as illustrated in specifically FIGS. 2, 16, 17 and 19, the respective splines are formed interiorly of the respective shell and tip internals. These splines are formed by broaching in a single pass. As is recognized, in broaching, the respective cylindrical shapes are moved on guides on a center so that all of the splines are formed by cutting away the grooves at one pass. This is much superior and less expensive process to the old milling of external cuts to form splines on the outer portion of the shells; which had to be done individually and which, even when finished, required perfect alignment when the pieces were pinned together in the prior art. Instead, with this new procedure, involving much simpler broaching, the parts are simply dropped into place with the spring 55 inserted so as to hold them together with the respective co-engaging stop means.

Figure 18:
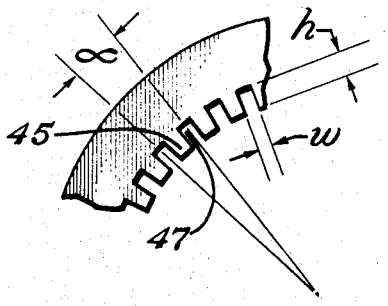
FIG. 18 is a partial view, broken away and enlarged for clarity of the splines and grooves interiorly of respective shell and intermediate tip internals.
Figure 19:
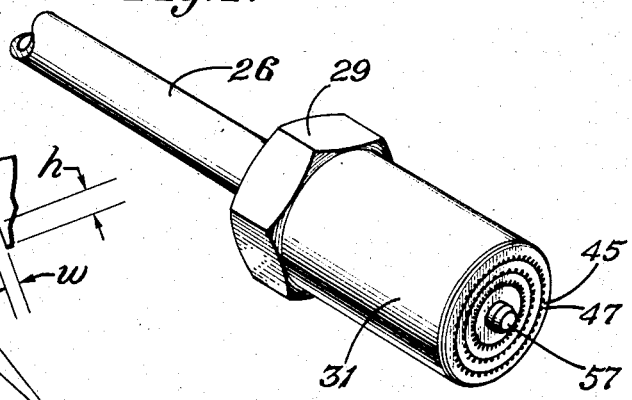

As can be seen in FIG. 18, the individual spline 45 and half of each of its respective grooves 47 on either side subtend an angle $\alpha$ for the respective shell and intermediate tip internals. Moreover, the grooves have a width w and the splines and grooves have a height h that make them perform as desired. For the torch tips which have been tried, it has been found that the angle $\alpha$ is slightly different depending upon the diameter of the particular circular section in which the grooves are formed. The height and width of the respective splines and grooves will vary somewhat depending upon the fuel gas, heating intensity and the like but have been found to be in the following range. The angle $\alpha$ subtended by a respective spline and half of the grooves on each side has been found to be in the range of 5 to 15 degrees depending upon whether it is on the intermediate tip internal or on the shell. Specifically, from ½ of one groove to ½ of the adjacent groove, the angle $\alpha$ as subtended is preferably about 7 to 13 degrees depending upon the size of the shell. For example, in the larger shells it may run in the range of 7–9 degrees; whereas in the intermediate shells it may run between 8 and 11 degrees and in the smaller shells it may run in the region of 10–13 degrees. We have found that about 12 degrees for a 10 T 55 shell, the smallest, works satisfactorily, whereas only about 7½ degrees works satisfactorily in the largest tip shells, such as a 20 T 55. Similarly, the height h of the spline 45 should be in the range of 0.040 inch–0.050 inch (″). For example a height of about 0.045 inch forms a satisfactory aperture when the radially interior edge of the spline engages the exterior of the next concentric intermediate tip internal as illustrated. Similarly, the width w of the respective grooves should be in the range of 0.020 inch–0.030 inch. In fact, a width of about 0.025 inch has been found to work satisfactorily. As can be seen in FIG. 2, the respective concentrically interior tip internals are emplaced radially internally of the respective sets of splines and grooves formed into the interior wall of the preceding shell or radially exterior tip internal. In this way, a complete set of tip internals, even the innermost tip internal 33, are easily emplaced by simply pushing the elements into place to facilitate assembly without requiring accurate positioning, drilling and pinning. Expressed otherwise, each tip internal is dropped into place and has its external stop means, such as 45° shoulder 51, pushed into engagement with the internal stop means 41 of the contiguous radially exterior tip internal or shell by the biasing means.

The biasing means, shown as a coil spring 55, may take any form desired and as appropriate. The coil spring 55 is preferably formed of Inconel to retain its temper at temperatures as high as 1200 degrees Fahrenheit or higher. In the illustrated embodiment, the outside diameter of the coil of the spring is in the range of 0.39–0.45 inch and the internal diameter of the coil is in the range of 0.29–0.30. The spring has a free length of about 0.6 inches plus or minus 0.05 inch. It will compress to a solid height of about 0.37–38 inch, although the maximum recommended loading is to about 0.44 inch.

The stub 57 has its tiny splines in the form of a 35 TPI straight knurl such as formed by 0.010 inch knurl. Of course, the dimensions of the stub 57 will be those that will allow its shaft 65 to be inserted inside the well 55 and obtain the desired frictional interference fit. The protruding head 67 has a beveled edge of about 30 degrees.

In operation, the torch tip is assembled as described hereinbefore. Specifically, the respective splines and grooves are formed on the internal wall of the shell and the respective intermediate tip internals. Thereafter, the respective intermediate tip internals, if any, are dropped into the shell in order of their radially decreasing diameters such that the respective stop means co-engage so as to hold against the biasing means 55 after the innermost tip internal 33 is emplaced. Of course the stub 57 is emplaced into the exterior end of the innermost tip internal. After the biasing means is dropped into place, the end piece is screwed into the skirt to hold the entire assembly in a unitary assembly. Thereafter the tip may be screwed onto the mixer elbow as desired in the particular heating torch arrangement. The oxygen and fuel are flowed through and burned exteriorly of the tip. If the tip inadvertently is hit against the work piece or other surface, the stub 57 allows flow to continue and prevents backfiring. Moreover, under the force of a severe blow, the stub 57 causes slight longitudinal movement of the respective tip internals interiorly of the shell and prevents flashback and burning and severe damage to the torch tip even though it is being handled carelessly.

From the foregoing, it can be seen that the improvement in the heating torch of this invention has the following advantages which accomplish the objects set out hereinbefore.

1. The tip parts are broached internally with inside splines such that they can be formed into a single pass; whereas the prior art external splines were individually milled, so the broaching cuts manufacturing costs.

2. The tip is easily assembled by simply dropping the parts in place, so assembly costs are cut.

3. The tip employs a biasing means which allows heat expansion of the parts without concern over creation of unequal heating.

4. The tip has a biasing means that keeps the assembly tightly together with no rattle as in the prior art tips where they were pinned together.

5. The tip has a biasing means which eliminates the need for costly aligning, drilling and pinning operations.

6. The tip is easily repairable by simply taking the worn out parts out and replacing them with new parts. The old design required redrilling the holes for the pins after a specific exact alignment was obtained, since the new part did not always match up with the old parts.

7. The stub eliminates backfire if the tip is lightly bumped against metal and allows underwriting approval.

8. One of the most important advantages is that if a tip is bumped against a metal, such as the heating surface, the work piece or the like with excessive force, the stub causes the center piece to push back against the end piece, blocking the flame from backfiring into the admixture, thereby eliminating flashback and burning.

9. The tip assembly is unique by having shouldering on a 45 degree flange so the tip internal readily fit to perfect assembly without requiring adjustments.

From the foregoing, it can be seen that the objectives of this invention are met.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In a heating torch in which a fuel and oxygen admixture is fed to a tip and burned at high temperature exteriorly of the torch tip for heating a work piece or the like and including:

a. a fuel passageway and valve for supplying a controlled flow of fuel;

b. an oxygen passageway and valve for supplying a controlled flow of oxygen;

c. a mixer for mixing said fuel and oxygen; said mixer being connected in fluid communication with both said fuel and oxygen passageways and valves and having a discharge end;

d. a tip for evenly flowing said fuel and oxygen exteriorly thereof for burning adjacent said workpiece for the heating thereof;

the improvement comprising having said tip in the form of a multiple piece unit comprising:

e. an end piece having at one end a centrally disposed aperture and passageway; said aperture and passageway having a section adapted to matingly and sealingly engage said discharge end of said mixer; said end piece having at its other end a shell attaching means for attaching a shell;

f. said shell having an end piece attaching means for sealingly connecting with said shell attaching means of said end piece and having an internal stop means for holding at least one tip internal interiorly thereof;

g. at least one tip internal disposed interiorly of said shell; said tip internal having an external stop means for keeping said tip internal interiorly of said shell responsive to said internal stop means of said shell and having a receiving means for receiving a biasing means for biasing said tip internal toward said internal stop means of said shell;

h. a stub disposed in said at least one tip internal and i. said biasing means being disposed so as to bias said tip internal toward said internal stop means of said shell such that said at least one tip internal can be easily and readily assembled interiorly of said shell and said biasing means emplaced and said biasing means will allow hitting said stub against said work piece without flashback burning.

2. The improved heating torch of claim 1 wherein said mixer is connected via an elbow with said tip, said elbow having a discharge end that is threaded and said aperture and passageway have matingly engaging threaded end for matingly engaging the threaded end of said elbow.

3. The improved heating torch of claim 2 wherein said discharge end of said elbow is provided with a male threaded section and wherein said aperture and passageway is provided with a female threaded section that matingly and sealingly engages the male threaded end of said elbow.

4. The improved heating torch of claim 1 wherein the other end of said end piece is threaded and wherein said shell is provided with a threaded section for matingly engaging said threaded end.

5. The improved heating torch of claim 4 wherein said threaded other end of said end piece is a male threaded section and said shell has a female threaded section that matingly and sealingly engages said threaded end of said end piece.

6. The improved heating torch of claim 1 wherein there are a plurality of tip internals that include an innermost tip internal and at least one intermediate tip internal intermediate said innermost tip internal and said shell; said intermediate tip internal having splines that seat against the exterior of a contiguous tip internal to define grooves for conveying the admixture of fuel and oxygen exteriorly of the tip for burning and heating said work piece; one of said at least one intermediate tip internal having its said external stop means engaging said internal stop means of said shell and defining on its interior and internal stop means for holding an internally disposed tip internal.

7. The improved heating torch of claim 6 wherein there are provided a plurality of intermediate tip internals disposed slideably concentrically, respectively within contiguous next exterior tip internals and about contiguous next interior tip internals with said splines defining respective concentric rings of said grooves; and wherein each said intermediate tip internal has its said external stop means engaging the internal stop means of a contiguous, radially exterior tip internal.

8. The improved heating torch tip of claim 7 wherein said internal stop means comprise square ends of said splines at the entrance to splined and grooved bores and said external stop means comprise radially exteriorly and concentrically extending shoulders for engaging said square ends of said splines.

9. The improved heating torch of claim 8 wherein said mixer includes a connected elbow means for flowing gas and having a discharge end having a male threaded section and said end piece has a female threaded section at the end of its central threaded bore for receiving the discharge end of said elbow, has a male threaded section at its other end for receiving the shell, said shell has a female threaded end for threadedly and matingly engaging said threaded other end of said end piece; wherein said biasing means comprises a coil spring disposed intermediate said end piece and an innermost tip internal; wherein said innermost tip internal has a stub disposed in its center at its exterior end for encountering a work piece or the like and preventing flashback and has a well at its interior end for receiving said coil spring; wherein said shell has interiorly disposed splines defining respective grooves, said splines engaging the exterior surface of an outer tip internal, said outer tip internal having an exteriorly regularly protruding shoulder for engaging the square ends of the splines of said shell for retaining said external tip internal against the force of said biasing means; said outer tip internal having splines defining grooves in said internal stop means for conformingly receiving a tip internal, said tip internal having radially concentrically outer exteriorly protruding shoulder for engaging the square ends of the splines of said outer tip internal for holding it in place against the force of said biasing means and providing internal stop means in the form of shoulders on said splines for seating against an innermost tip internal such that said stub can encounter the workpiece or other items if the tip is handled roughly and move said respective tip internals interiorly and slideably with respect each other or said shell to prevent flashback and burning, yet said shell and tip internals will be moved into place by said biasing means after receiving said flow and continue to function normally.

10. The improved heating torch of claim 9 wherein said end piece has a flat surface and said well has interiorly protruding cylindrical walls that can be pushed into said flat surface to block a flashback flame from entering the mixer.

* * * * *